US007766728B2

(12) United States Patent
Williamson et al.

(10) Patent No.: US 7,766,728 B2
(45) Date of Patent: Aug. 3, 2010

(54) COLLAPSIBLE ENCLOSURE FOR A MACHINE TOOL

(76) Inventors: Tony Williamson, 1407 Cedar La., Estes Park, CO (US) 80517; Dan Weis, 909 Des Moines Ave., Loveland, CO (US) 80537

( * ) Notice: Subject to any disclaimer, the term of this patent is extended or adjusted under 35 U.S.C. 154(b) by 1498 days.

(21) Appl. No.: 11/116,034

(22) Filed: Apr. 27, 2005

(65) Prior Publication Data

US 2006/0243312 A1 Nov. 2, 2006

(51) Int. Cl.
*B24B 55/04* (2006.01)

(52) U.S. Cl. ..... 451/451; 451/455

(58) Field of Classification Search ..... 451/451, 451/452, 454, 455, 457; 135/125, 126, 128
See application file for complete search history.

(56) References Cited

U.S. PATENT DOCUMENTS 3,629,875 A * 12/1971 Dow et al. ..... 4/599
4,239,247 A * 12/1980 Hinz ..... 280/19.1
4,423,568 A * 1/1984 Gould ..... 451/178
4,484,845 A 11/1984 Pennella, Jr. et al.
4,656,995 A 4/1987 Merwin
4,811,527 A 3/1989 Ruopsa
4,928,581 A * 5/1990 Jacobson ..... 454/340
4,975,992 A * 12/1990 Patterson et al. ..... 4/599
5,457,915 A 10/1995 Voege
5,577,955 A 11/1996 Voege
5,749,387 A * 5/1998 Thompson ..... 135/146
6,257,222 B1 7/2001 Kaeser
6,557,602 B1 5/2003 Sorensen et al.
6,631,590 B1 * 10/2003 Glowaski ..... 52/63
6,796,890 B1 9/2004 Goldrick

* cited by examiner

*Primary Examiner*—Dung Van Nguyen
(74) *Attorney, Agent, or Firm*—Leyendecker & Lemire, LLC; Albert Haegele

(57) ABSTRACT

A method and apparatus are provided for a collapsible enclosure for a machine tool. According to one embodiment, a collapsible enclosure for a machine tool comprises a substantially waterproof pan. The pan comprises a base portion and a wall portion extending from the base portion around substantially all of an outer edge of the base portion. The collapsible enclosure further comprises a collapsible frame resting on the base portion of the pan and erected inside of the wall portion of the pan. A substantially waterproof cover substantially surrounds the collapsible frame and extends into the pan to overlap an inner side of the wall portion of the pan.

12 Claims, 10 Drawing Sheets

COLLAPSIBLE ENCLOSURE FOR A MACHINE TOOL

FIELD OF THE INVENTION

The invention relates generally to the field of machine tool enclosures. More particularly, the invention relates to a collapsible enclosure for a machine tool.

BACKGROUND OF THE INVENTION

Machine tools, such as various types of lathes, mills, drills, saws, etc., are widely used by craftsmen, tradesmen, and laypeople for a wide variety of jobs or projects. For example, wet saws are used to cut tiles, stones, masonry, etc. Such saws use a water spray directed on or near the cutting blade to keep down dust and facilitate cutting. However, such saws create runoff or wastewater that can accumulate under or near the saw creating a hazard. Similarly, other machine tools can create dust or debris that, if not confined, can, in the least, take time and effort to clean up or, in some situations, may create a hazard.

Various types of attachments or enclosures for machine tools are available. Many of these are safety shields to prevent an operator or bystander from being accidentally cut or injured by the tool when it is in use. However, such safety shields do little or nothing to confine the dirt, dust, debris, or runoff created by the tool. Further, such shields add significantly to the bulk of the tool and cannot be easily removed and stored.

Other available enclosures are similarly rigid and bulky. For example, a typical enclosure for a machine tool includes a number of Plexiglas® or other rigid walls or sides. Such an enclosure cannot be easily or conveniently stored. Therefore, such enclosures do not provide a water or dust containing environment that can be easily disassembled, cleaned, and packed away for easy and convenient transportation and/or storage. It is with respect to these considerations and others that the present invention has been made.

SUMMARY OF THE INVENTION

In accordance with the present invention, the above and other problems are solved by a collapsible enclosure for a machine tool such as a wet saw. Such an enclosure can provide a substantially waterproof or dust containing environment in which a wet saw or other type of machine tool can be operated. When not in use, the enclosure can be collapsed for easy transportation and/or storage.

According to one embodiment, a collapsible enclosure for a machine tool comprises a substantially waterproof pan. The pan comprises a base portion and a wall portion extending from the base portion around substantially all of an outer edge of the base portion. The collapsible enclosure further comprises a collapsible frame resting on the base portion of the pan and erected inside of the wall portion of the pan. A substantially waterproof cover substantially surrounds the collapsible frame and extends into the pan to overlap an inner side of the wall portion of the pan.

Other features of the present invention will be apparent from the accompanying drawings and from the detailed description that follows.

DETAILED DESCRIPTION

Figure 1:
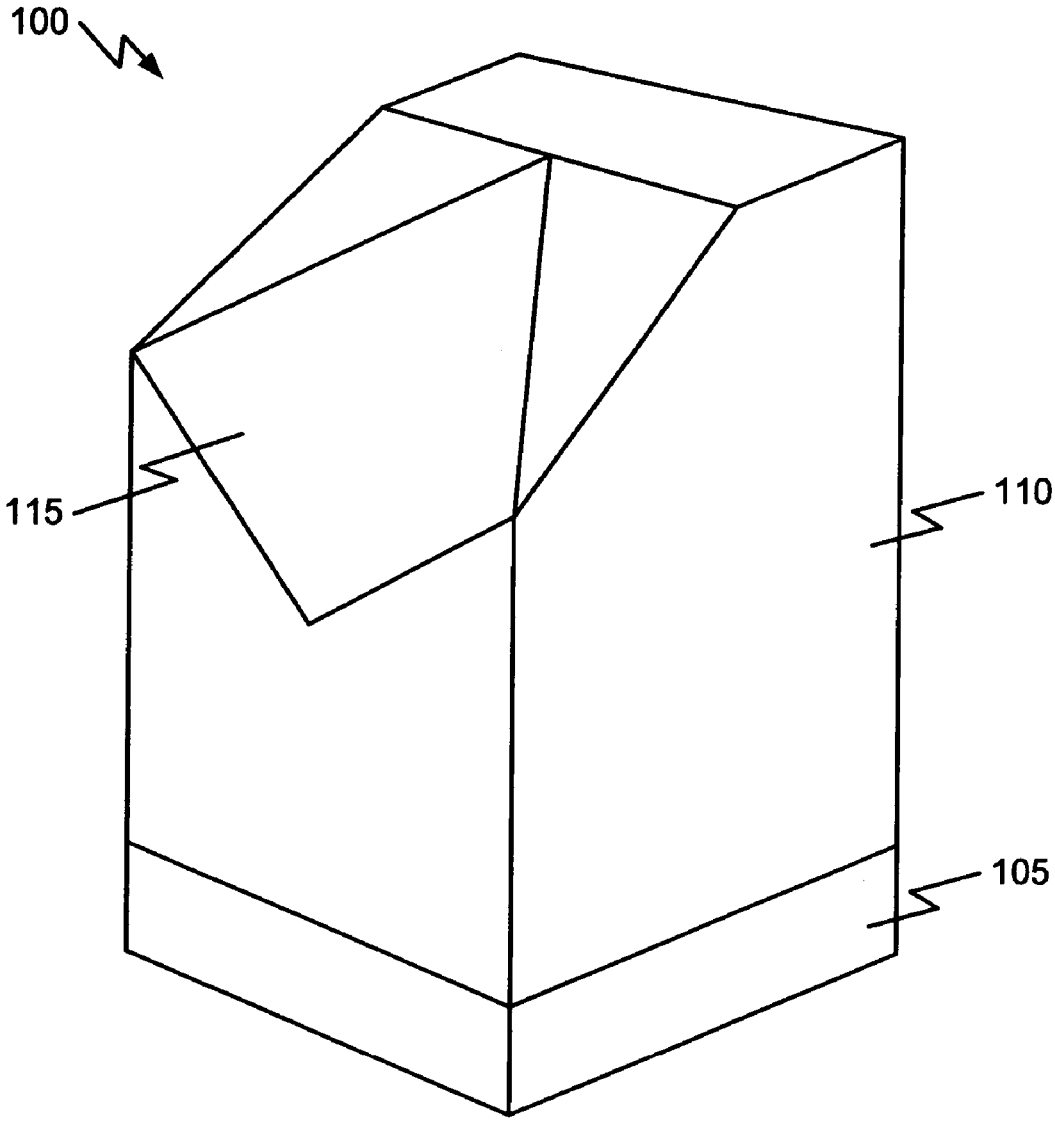
FIG. 1 is a perspective view of a collapsible enclosure for a machine tool according to one embodiment of the present invention.

A method and apparatus are described for a collapsible enclosure for a machine tool such as a wet saw. Such an enclosure can provide a substantially waterproof or dust containing environment in which a wet saw or other type of machine tool can be operated. When not in use, the enclosure can be collapsed for easy transportation and/or storage.

According to one embodiment, a collapsible enclosure for a machine tool comprises a substantially waterproof pan. The pan comprises a base portion and a wall portion extending from the base portion around substantially all of an outer edge of the base portion. The collapsible enclosure further comprises a collapsible frame resting on the base portion of the pan and erected inside of the wall portion of the pan. A substantially waterproof cover substantially surrounds the collapsible frame and extends into the pan to overlap an inner side of the wall portion of the pan.

As an initial matter, some terms used throughout this description are defined below.

TERMINOLOGY

The term "or" as used in this specification and the appended claims is not meant to be exclusive rather the term is inclusive meaning "either or both".

References in the specification to "one embodiment", "an embodiment", "a preferred embodiment", "an alternative embodiment", "one variation", "a variation" and similar phrases mean that a particular feature, structure, or characteristic described in connection with the embodiment or variation is included in at least an embodiment or variation of the invention. The phrase "in one embodiment", "in one variation" or similar phrases as used in various places in the specification are not necessarily meant to refer to the same embodiment or the same variation.

The term "couple" or "coupled" as used in this specification and the appended claims refers to either an indirect or direct connection between the identified elements, components or objects. Often the manner of the coupling will be related specifically to the manner in which the two coupled elements interact.

The term "indicia" refers to any words, phrases, numbers, logos, pictures and/or symbols that are intended by an originator of the indicia to have meaning to a viewer thereof.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

The term "cutout" as used herein refers to a hole or space in the sheet material that is substantially surrounded by remaining sheet material excepting a slot, a slit or some similar feature extending from an outside edge to the cutout. In contrast, the term "cutaway" as used herein refers to an area wherein sheet material is removed (or could have been removed) and wherein at least one outside edge of the remaining sheet material directly abuts the cutaway.

Importantly, while embodiments of the present invention will be described with reference to an enclosure for a wet saw, the method and apparatus described herein are equally applicable to other types of machine tools. For example, the techniques described herein are thought to be useful in connection with various types of lathes, mills, drills, saws, etc.

FIG. 1 is a perspective view of a collapsible enclosure for a machine tool according to one embodiment of the present invention. In this example, the collapsible enclosure 100 includes a substantially waterproof pan 105. As will be seen, the pan can include a base portion and a wall portion extending from the base portion around substantially all of an outer edge of the base portion to form a tub or basin that will collect runoff, wastewater, dust, dirt, debris, etc. from a machine tool operated inside of the enclosure 100. According to one embodiment of the present invention, the pan 105 may be constructed of a lightweight and flexible yet waterproof material such as vinyl or waterproof treated nylon or canvas. In such a case, the pan 105 can be easily folded and/or rolled for storage when the enclosure 100 is disassembled.

Although not visible in this view, a collapsible frame rests on the base portion of the pan and is erected inside of the wall portion of the pan to provide support for the enclosure 100. Details of the frame will be discussed below with reference to FIGS. 4 through 9.

According to one embodiment of the present invention, a substantially waterproof cover 110 substantially surrounds the collapsible frame. The bottom of the cover 110 can extend into the pan 105 to overlap an inner side of the wall portion of the pan 105. In this way, wastewater or other debris can run or fall down the insides of the cover 110 and into the pan 105 without leaking out of the enclosure 100.

As illustrated in the example shown in FIG. 1, the cover can further define an opening 115 on one or more sides of the collapsible enclosure 100. The opening 115 can be adapted to provide access to a machine tool placed into the collapsible enclosure 100. The exact size, shape, location, or number of openings can vary without departing from the scope of the present invention.

The cover 110, as with the pan, may be constructed of a lightweight and flexible yet waterproof material such as vinyl or waterproof treated nylon or canvas. In such a case, the cover 110 can be easily folded and/or rolled for storage when the enclosure 100 is disassembled. According to one embodiment of the present invention, the cover 110 may be constructed of a clear vinyl or similar material to allow light into the enclosure 100 and allow viewing of the tool and work pieces from outside the enclosure 100. Additional details of the cover 110 will be discussed below with reference to FIG. 3.

As shown here, the top front portion of the enclosure 100 may be angled somewhat to provide easier access to the inside of the enclosure 100 by an operator standing outside the enclosure 100. Alternatively, the enclosure may be straight rather than angled. Further, while shown in the attached Figures as being rectangular, the enclosure 100 may be any of a variety of different shapes and sizes without deviating from the scope of the present invention.

Figure 2:
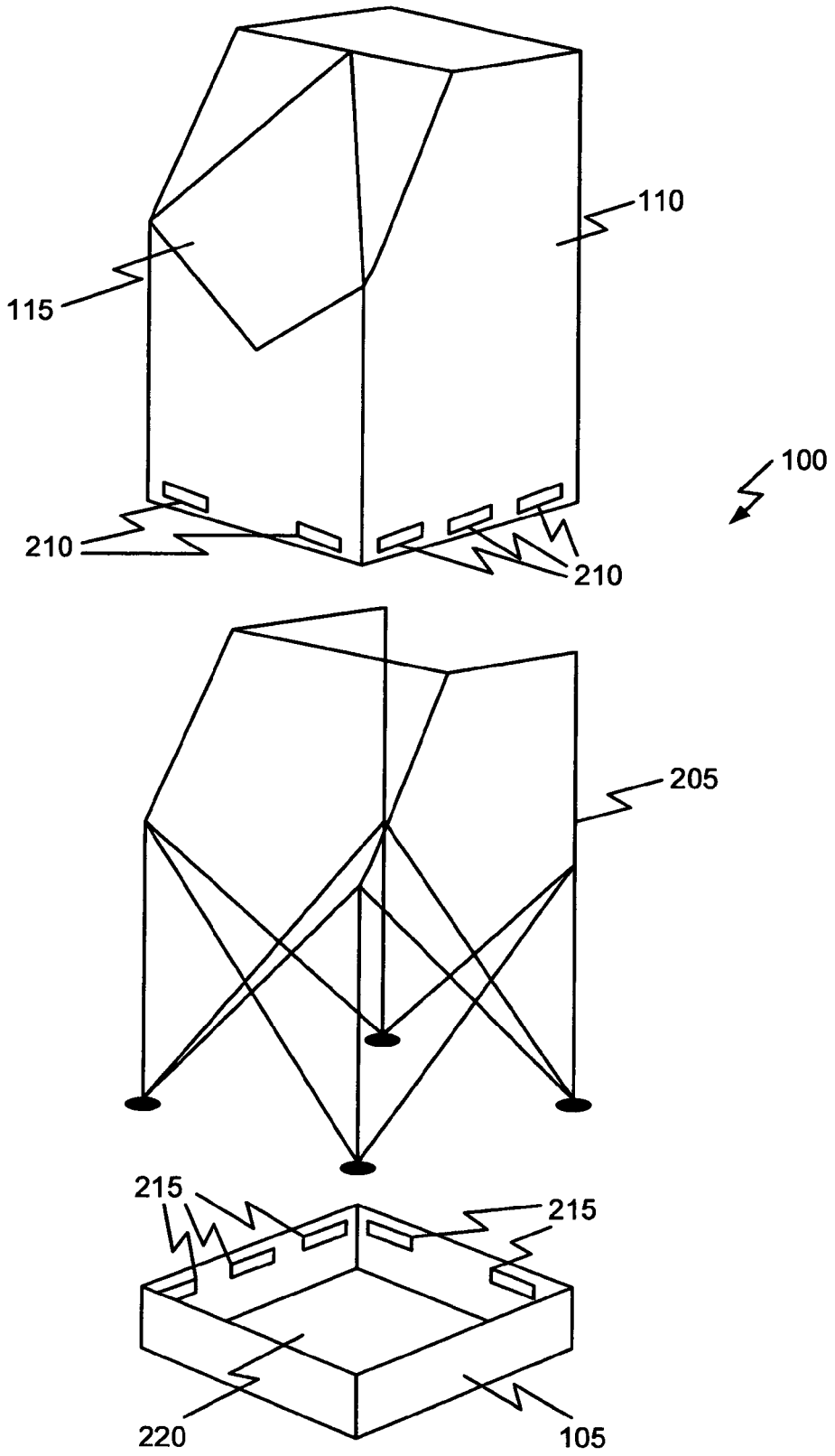
FIG. 2 is an exploded perspective view of a collapsible enclosure according to the embodiment illustrated in FIG. 1.

FIG. 2 is an exploded perspective view of a collapsible enclosure according to the embodiment illustrated in FIG. 1. This example shows the enclosure 100 consisting of the pan 105 and cover 110 as discussed above. Also visible in this view is the frame 205. As discussed above, the enclosure 100 can comprise the substantially waterproof pan 105 having a base portion 220 and a wall portion 225 extending from the base portion 220 around substantially all of an outer edge of the base portion 220 to form a tub or basin that will collect runoff, wastewater, dust, dirt, debris, etc. from a machine tool operated inside of the enclosure 100. According to one embodiment of the present invention, the pan 105 may be constructed of a lightweight and flexible yet waterproof material such as vinyl or waterproof treated nylon or canvas. In such a case, the pan 105 can be easily folded and/or rolled for storage when the enclosure 100 is disassembled.

The a collapsible frame 205 rests on the base portion 220 of the pan 105 and is erected inside of the wall portion 225 of the pan 105 to provide structural support to the enclosure 100. The frame 205 can be constructed of a variety of materials but may preferably be constructed of a lightweight, corrosion resistant material such as various plastics including but not limited to polyvinylchloride (PVC), thermoplastics, etc. Alternatively, the frame 205 may be constructed of other materials such as aluminum or stainless steel tubing or others. Regardless of the material used, the frame 205 provides structural support for the enclosure 100 but can be easily collapsed for transportation and/or storage. Additional details of the structure and function of the frame 205 will be discussed below with reference to FIGS. 4-9.

As described above, a substantially waterproof cover 110 substantially surrounds the collapsible frame 205. The bottom of the cover 110, when placed over the frame 205, can extend into the pan 105 to overlap an inner side of the wall portion 225 of the pan 105. In this way, wastewater or other debris can run or fall down the insides of the cover 110 and into the pan 105 without leaking out of the enclosure 100. According to one embodiment of the present invention, wall portion 225 of the pan 105 further comprises one or more fasteners 215 on an inner side of the wall portion 225. Additionally, the cover 110 may further comprise one or more fasteners 210 on an edge of the cover overlapping the inner side of the wall portion 225 of the pan 105. The one or more fasteners 210 on the cover 110 can be adapted to couple with the one or more fasteners 215 on the inner side of the wall portion 225 of the pan 105. For example, the fasteners 210 and 215 may comprise hook and loop fasteners such as Velcro®, snaps, zippers, or other types of fasteners.

As described above, the cover 110, as with the pan 105, may be constructed of a lightweight and flexible yet waterproof material such as vinyl or waterproof treated nylon or canvas. In such a case, the cover 110 can be easily folded and/or rolled for storage when the enclosure 100 is disassembled. According to one embodiment of the present invention, the cover 110 may be constructed of a lightweight and flexible yet waterproof material allowing the cover to be folded and/or rolled. In one example, the cover 110 may be constructed, in whole or in part, of a clear vinyl or similar material to allow light into the enclosure 100 and allow viewing of the tool and work pieces from outside the enclosure 100.

Therefore, the enclosure can be erected by laying the pan 105 in a desired location. The frame 205 can then be placed into the pan 105 and expanded so that the bottom of the frame 205 rests on the base portion 220 of the pan 105 and is erected inside of the wall portion 225 of the pan 105. The cover 110 can then be placed over the frame 205 with the bottom of the cover 110 extending into the pan 105 to overlap the inner side of the wall portion 225 of the pan 105. The fasteners 210 and 215, if used, can then be fastened together to secure the enclosure 100.

Disassembly of the enclosure 100 can be accomplished in a reverse manner. That is, the fasteners 210 and 215, if any, can be unfastened, and the cover 110 removed and folded and/or rolled. The frame 205 can then be collapsed and removed from the pan 105 which can then be folded and/or rolled. According to one embodiment of the present invention, the folded/rolled cover 110, collapsed frame 205, and folded/rolled pan can then be placed in a case or bag (not shown here) for transportation and/or storage.

A machine tool such as a wet saw can be placed into the enclosure through the opening 115 and placed into the pan 105. Alternatively, the tool may be placed into the pan 105 prior to the enclosure 100 being assembled. That is, the pan 105 can be laid out in a desired location. The tool can then be placed onto the pan 105 and the frame erected or placed over/around the tool onto the pan 105. The cover 110 can then be placed over the frame to compete the enclosure 100. An operator can then use the tool by reaching through the opening 115.

Figure 3:
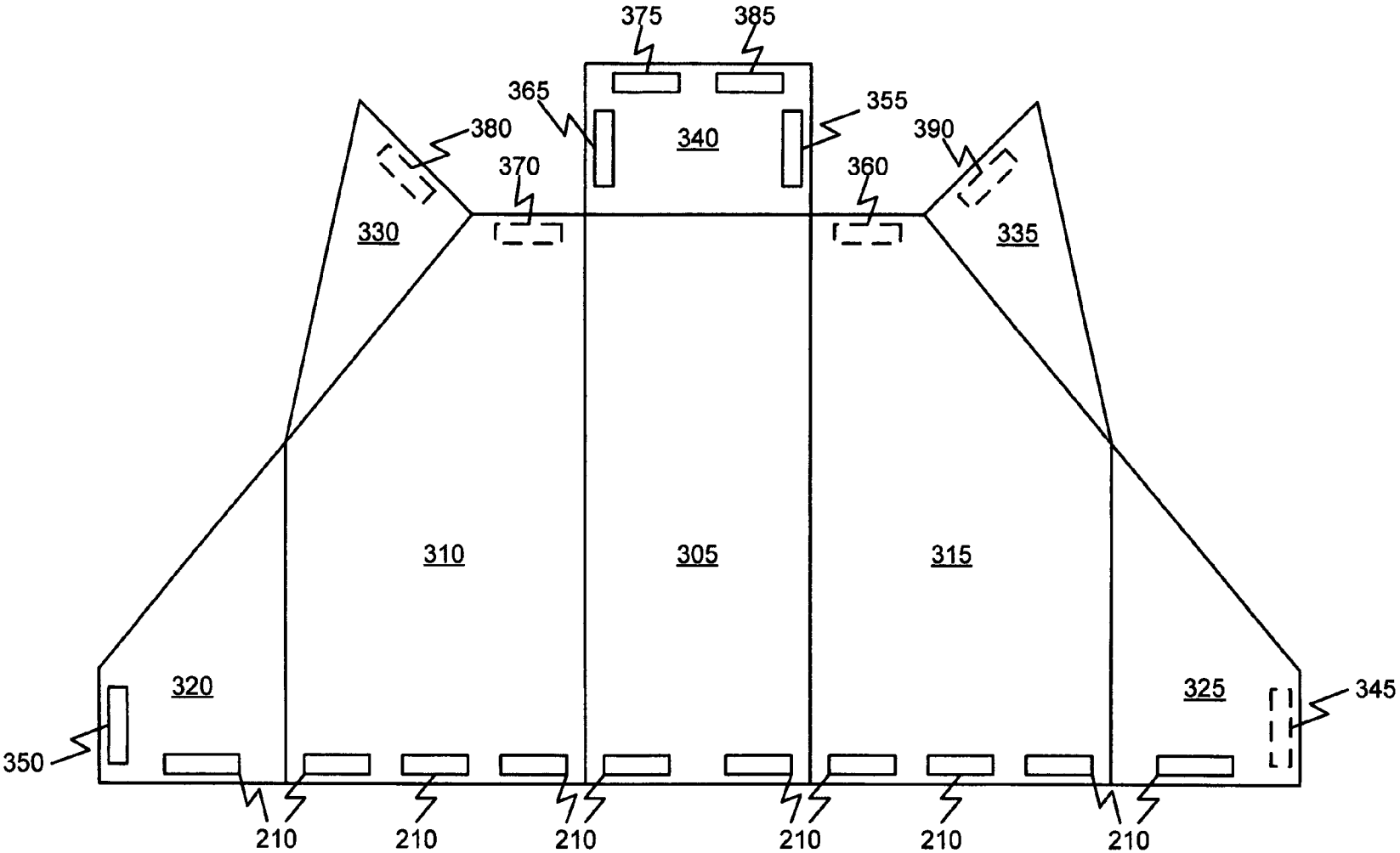
FIG. 3 is a plan view of a cover for a collapsible enclosure according to one embodiment of the present invention.

FIG. 3 is a plan view of a cover for a collapsible enclosure according to one embodiment of the present invention. In this example, the cover 110 comprises a substantially rectangular sheet with a plurality of fasteners 210 and 345-390 near outer edges of the sheet. As shown here, the sheet also consists of a number of panels 305-340. These panels include a rear panel 305, a right side panel 310, a left side panel 315, a right lower front panel 320, a left lower front panel 325, a right upper front panel 330, a left upper front panel 335, and a top panel 340. Each of these names refers to the location of the particular panel when the cover is placed over and around the frame to assemble the enclosure. Therefore the names are used solely for reference and should not be considered limiting. Further, as noted above, the size and shape of the enclosure can vary significantly without departing from the scope of the present invention. Therefore, the exact size, shape and structure of the cover can vary accordingly. The shape and structure of the exemplary cover illustrated here should not be considered limiting.

Fasteners 210 along the bottom edge of the cover 110 are shown. As noted above, these fasteners 210 can be used to secure the cover 110 to the pan when the enclosure is assembled. Additionally, a number of other fasteners 345-390 are shown along the edges of various panels 310-340. The fasteners 345-390 may comprise hook and loop fasteners such as Velcro®, snaps, zippers, or other types of fasteners. These fasteners 345-390 can be adapted to secure opposing edges of the sheet when the sheet is placed over and folded around the frame of the collapsible enclosure.

For example, the fasteners 345-390 can include a left lower front panel fastener 345, a right lower front panel fastener 350, a top panel left side fastener 355, a left side panel top fastener 360, a top panel right side fastener 365, a right side panel top fastener 370, top panel front fastener 375, a right upper front panel fastener 380, top panel front fastener 385, and a left upper front panel fastener 390. When the cover 110 is placed over and wrapped around the frame, the top panel left side fastener 355 can be secured to the left side panel top fastener 360, the top panel right side fastener 365 can be secured to the right side panel top fastener 370, the top panel front fastener 375 can be secured to the right upper front panel fastener 380, the top panel front fastener 385 can be secured to the left upper front panel fastener 390, and the left lower front panel fastener 345 can be secured to the right lower front panel fastener 350 to secure the cover 110 around the frame. Other arrangements and locations of fasteners are contemplated and considered to be within the scope of the present invention.

Figure 4:
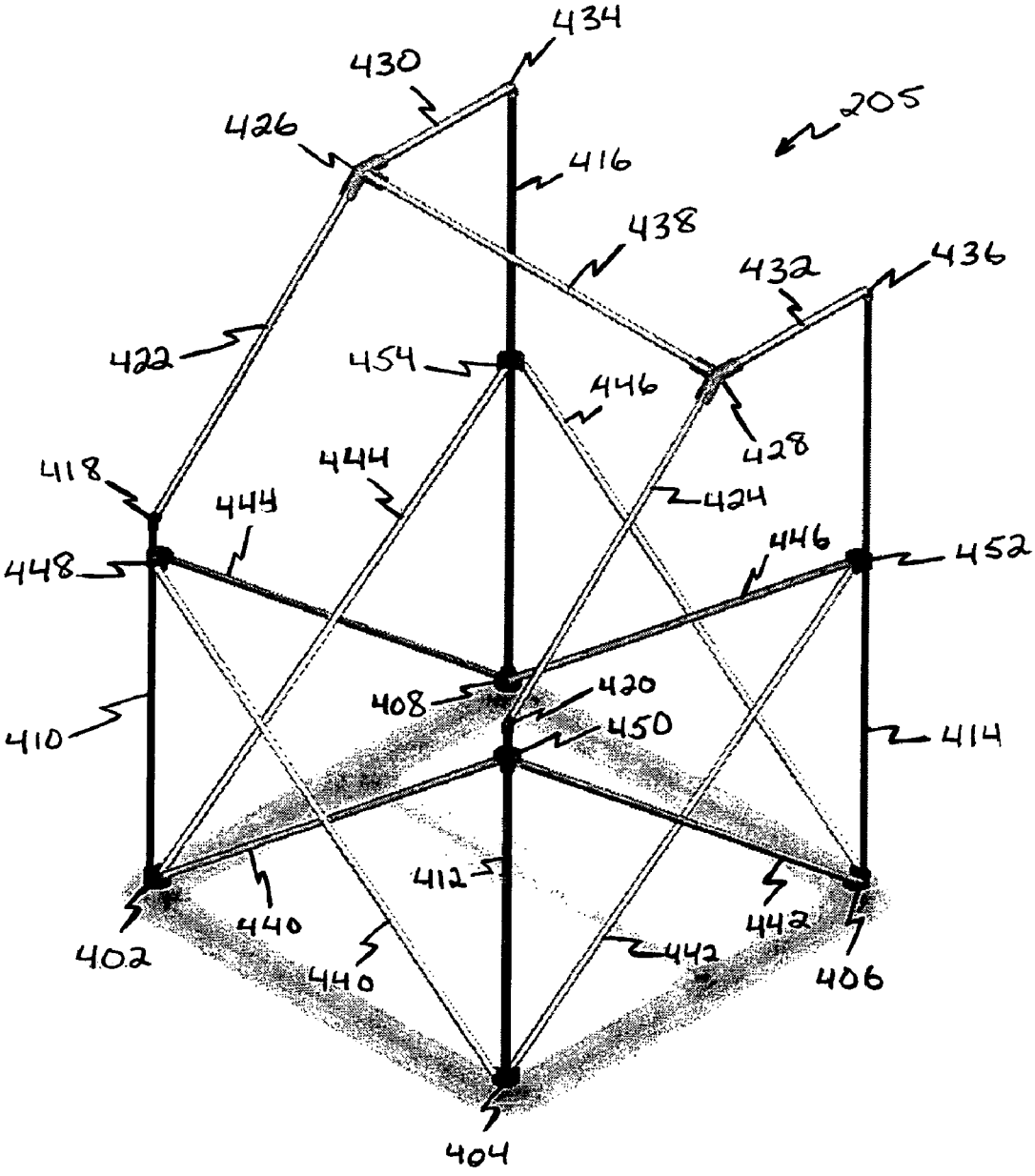
FIG. 4 is a perspective view of a frame for a collapsible enclosure according to one embodiment of the present invention.

FIG. 4 is a perspective view of a frame for a collapsible enclosure according to one embodiment of the present invention. In this example, the frame 205 comprises a plurality of upright members 410-416 and a plurality of base hinges 402-408. Each base hinge 402-408 can be mounted on or near a bottom end of each of the plurality of upright members 410-416.

A plurality of cross member hinges 448-454 are shown. Each cross member hinge 448-454 can be slidably coupled with each of the plurality of upright members 410-416. A plurality of cross members 440-446 can be coupled with each of the plurality of base hinges 402-408 and an opposing cross member hinge 448-454. Preferably, the cross members 440-446 extend along an outside perimeter of the frame. For example, front cross members 440 extend from and are coupled with the left front base hinge 402 to the right front cross member hinge 450 and the right front base hinge 404 to the left front cross member hinge 448. Similarly, right side cross members 442 extend from and are coupled with the right front base hinge 404 to the right rear cross member hinge 452 and the right rear base hinge 406 to the right front cross member hinge 450, left side cross members 444 extend from and are coupled with the left side base hinge 402 to the left rear cross member hinge 454 and the left rear base hinge 408 to the left front cross member hinge 448, and rear cross members 446 extend from and are coupled with the left rear base hinge 408 to the right rear cross member hinge 452 and the right rear base hinge 406 to the left rear cross member hinge 454.

Each cross member 440-446 can be adapted to pivot about the base hinge 402-408 with which the cross member 440-446 is coupled in at least one direction in relation to the upright member 410-416 on which the base hinge 402-408 is mounted. Additionally, each cross member 440-446 can be adapted to pivot about the cross member hinge 448-454 with which the cross member 440-446 is coupled in at least one direction in relation to the upright member 410-416 with which the cross member hinge 448-454 is coupled. As will be seen, the pivoting of the cross members 440-446 about the base hinges 402-408 and the cross member hinges 448-454 and the sliding of the cross member hinges 448-454 along the upright members 410-416 allows the frame 205 to be easily erected and collapsed.

As noted above and shown here, the enclosure may have a slanted portion along the front. Therefore, front upright members 410 and 412 are shorter than rear upright members 414 and 416. Upright member extensions 422 and 424 may be coupled with front upright members 410 and 412 at a desired angle by flexible joints 418 and 420. Flexible joints 418 and 420 allow upright member extensions 422 and 424 to pivot to be substantially collinear with front upright members 410 and 412. Additionally, flexible joints 418 and 420 and front cross member hinges 448 and 450 can be sized to allow the cross member hinges 448 and 450 to slide along upright members 410 and 412, over flexible joints 418 and 420, and along upright member extensions 422 and 424 when the frame is collapsed or erected.

The frame 205 can further comprise one or more support members 430, 432, and 438 removably coupled with opposing upright members 410-416 at an end of the upright member 410-416 opposite the base hinges 402-408. These support members 430, 432, and 438 can be adapted to prevent the upright members 410-416 from moving toward each other when the frame 205 is erected. As shown here, the support members 430, 432, and 438 comprise left top horizontal member 430, right top horizontal member 432, and top front lateral member 438. Left top horizontal member 430 can be coupled with left rear upright member 416 via joint 434 and left upright member extension 422 via three-way joint 426. Similarly, right top horizontal member 432 can be coupled with right rear upright member 414 via joint 436 and right upright member extension 424 via three-way joint 428. Top front lateral member 438 can extend between and be removably coupled with three-way joints 426 and 428.

Joints 434 and 436 can be elbow joints removably coupled with upright members 414 and 416. Three-way joints 426 and 428 allow top front lateral member 438 to be removed from the frame 205 and either allow top horizontal members 430 and 432 to pivot relative to upright member extensions 422 and 424 respectively or to allow top horizontal members 430 and 432 to be removed from the frame 205 when the frame is collapsed.

Therefore, the frame 205 can be collapsed by removing lateral support member 438 and disconnecting horizontal support members 430 and 432 from upright members 414 and 416. Then forcing the upright members 410-416 towards each other causes each cross member 440-444 to pivot about the base hinge 402-408 with which the cross member 440-444 is coupled and the cross member hinge 448-454 with which the cross member 440-444 is coupled and causes each cross member hinge 448-454 to slide along each upright member 410-416 in a direction away from the base hinges 402-408. Assembly of the frame 205 can be accomplished by reversing these steps.

Figure 5:
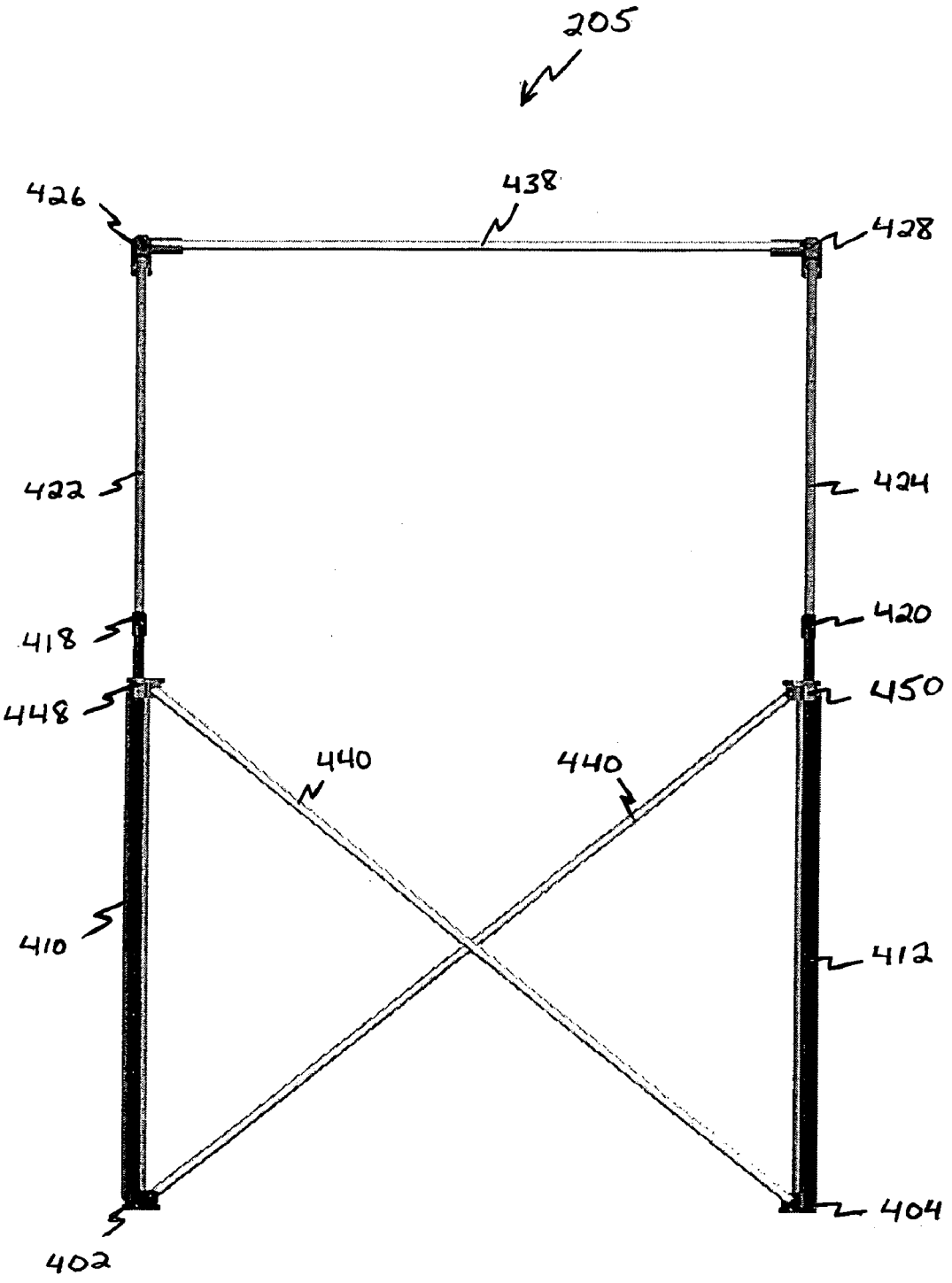
FIG. 5 is a front view of a frame for a collapsible enclosure according to the embodiment illustrated in FIG. 4.

FIG. 5 is a front view of a frame for a collapsible enclosure according to the embodiment illustrated in FIG. 4. This view shows upright members 410 and 412 extending from base hinges 402 and 404. Upright extensions 422 and 424 are coupled with upright members 410 and 412 via flexible joints 418 and 420. Lateral support member 438 is coupled with the top of upright extensions 422 and 424 by three-way joints 426 and 428 respectively. Cross members 440 extend from and are coupled with the left front base hinge 402 to the right front cross member hinge 450 and the right front base hinge 404 to the left front cross member hinge 448.

Figure 6:
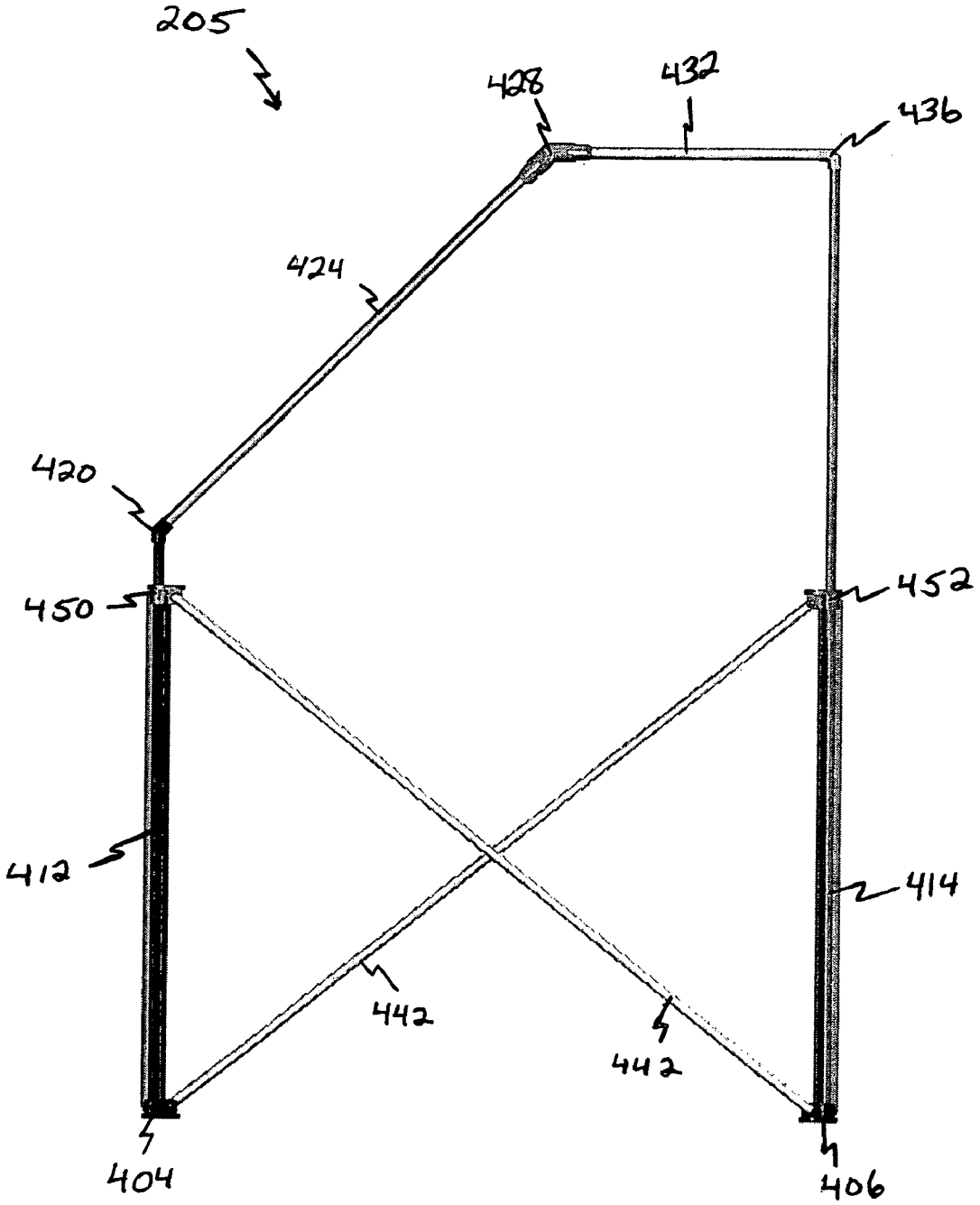
FIG. 6 is a side view of a frame for a collapsible enclosure according to the embodiment illustrated in FIG. 4.

FIG. 6 is a side view of a frame for a collapsible enclosure according to the embodiment illustrated in FIG. 4. This view shows upright members 412 and 414 extending from base hinges 404 and 406. Upright extension 424 is coupled with upright member 412 via flexible joint 420. Horizontal support member 432 is coupled with the top of upright extensions 424 and upright member 414 by three-way joint 428 and joint 436 respectively. Cross members 442 extend from and are coupled with the right front base hinge 404 to the right rear cross member hinge 452 and the right rear base hinge 406 to the right front cross member hinge 450.

Figure 7:
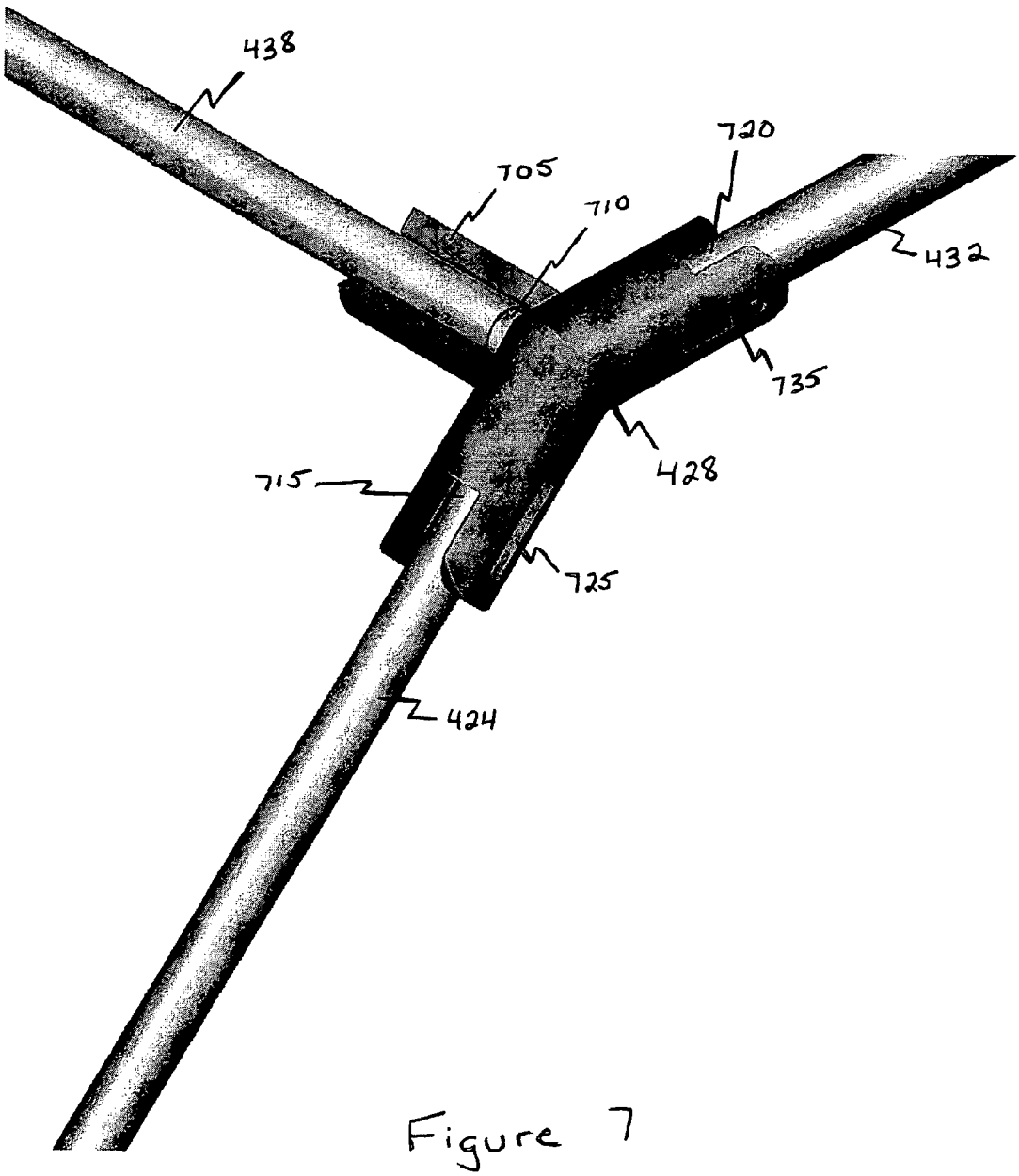
FIG. 7 is a perspective view of a three-way joint suitable for use with a frame for a collapsible enclosure according to the embodiment illustrated in FIG. 4.

FIG. 7 is a perspective view of a three-way joint suitable for use with a frame for a collapsible enclosure according to the embodiment illustrated in FIG. 4. This example shows three-way joint 428 coupled with upright extension 424, horizontal support 432, and lateral support 438 as described above with reference to FIGS. 4-6.

As noted, lateral support 438 can be removably coupled with three-way joint 428. In this example, three-way joint 428 comprises a half-round extension 705 and a post 710 extending from one side adapted to receive a hollow end of lateral support 438. Other configurations are also contemplated. For example, a full-round extension may be used in place of half-round extension 705 and post 710 may be omitted. In this case, the end of lateral support 438 is received and supported by the full-round extension. Alternatively, half-round extension 705 may be omitted and a hollow end of lateral support 438 can receive and be supported by post 710. Other variations are contemplated and considered to be within the scope of the present invention.

Also as noted above, upright extension 424 and horizontal support 432 may be coupled with three-way joint 428 in a variety of ways. For example, the ends of upright extension 424 and horizontal support 432 may be removably coupled with three-way hinge 428 in any of the manners discussed above for coupling lateral support 438 with three-way hinge 428. Alternatively, the ends 715 and 720 of upright extension 424 and/or horizontal support 432 respectively can be hinged within three-way joint 428. For example, a pin (not shown here) can extend through slot 725 in three-way joint 428 and through the end 715 of upright extension 424. The end 715 of upright extension 424 can then slide into and out of an orifice (not shown here) in three-way joint 428 as the pin slides in slot 725. As the end 715 of upright extension 424 slides out of the orifice, upright extension 424 is free to pivot about the pin in slot 725. Similarly, a pin (not shown here) can extend through slot 735 in three-way joint 428 and through the end 720 of horizontal support 432. The end 720 of horizontal support 432 can then slide into and out of an orifice (not shown here) in three-way joint 428 as the pin slides in slot 735. As the end 720 of horizontal support 432 slides out of the orifice, horizontal support 432 is free to pivot about the pin in slot 735. Other variations are contemplated and considered to be within the scope of the present invention.

Figure 8:
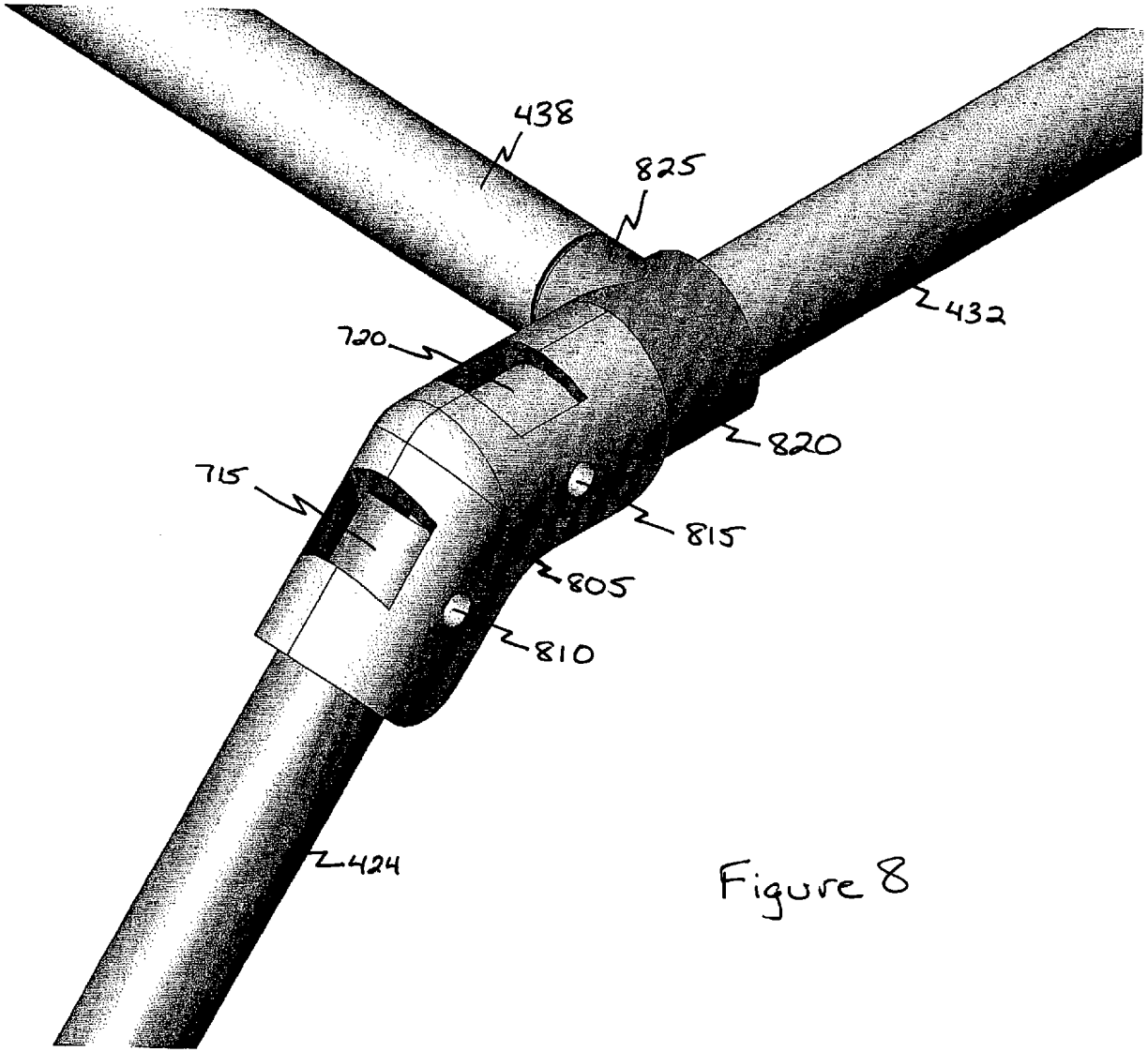
FIG. 8 is a perspective view of an alternative embodiment of a three-way joint suitable for use with a frame for a collapsible enclosure according to the embodiment illustrated in FIG. 4.

FIG. 8 is a perspective view of an alternative embodiment of a three-way joint suitable for use with a frame for a collapsible enclosure according to the embodiment illustrated in FIG. 4. This example shows a three-way joint 805 coupled with upright extension 424, horizontal support 432, and lateral support 438 as described above with reference to FIGS. 4-6.

As noted, lateral support 438 can be removably coupled with three-way joint 805. In this example, three-way joint 805 comprises a sleeve extension 820 adapted to receive the horizontal support 432. The sleeve extension may be coupled with the three-way joint 805 or may be free to slide along the horizontal support 432. A post 825 extends from one side of the sleeve extension and is adapted to receive a hollow end of lateral support 438. Other configurations are also contemplated.

Also as noted above, upright extension 424 and horizontal support 432 may be coupled with three-way joint 805 in a variety of ways. For example, the ends of upright extension 424 and horizontal support 432 may be removably coupled with three-way joint 805 in any of the manners discussed above for coupling lateral support 438 with three-way joint 805. Alternatively, the ends 715 and 720 of upright extension 424 and/or horizontal support 432 respectively can be hinged within three-way joint 805. For example, a pin (not shown here) can extend through hole 810 in three-way joint 805 and through the end 715 of upright extension 424. The end 715 of upright extension 424 can then pivot about the pin and through a slot (not shown here) in the bottom of the three-way joint 805. Similarly, a pin (not shown here) can extend through slot 735 in three-way joint 805 and through the end 720 of horizontal support 432. The end 720 of horizontal support 432 can then pivot about the pin and through a slot (not shown here) in the bottom of the three-way joint 805. Other variations are contemplated and considered to be within the scope of the present invention.

Figure 9:
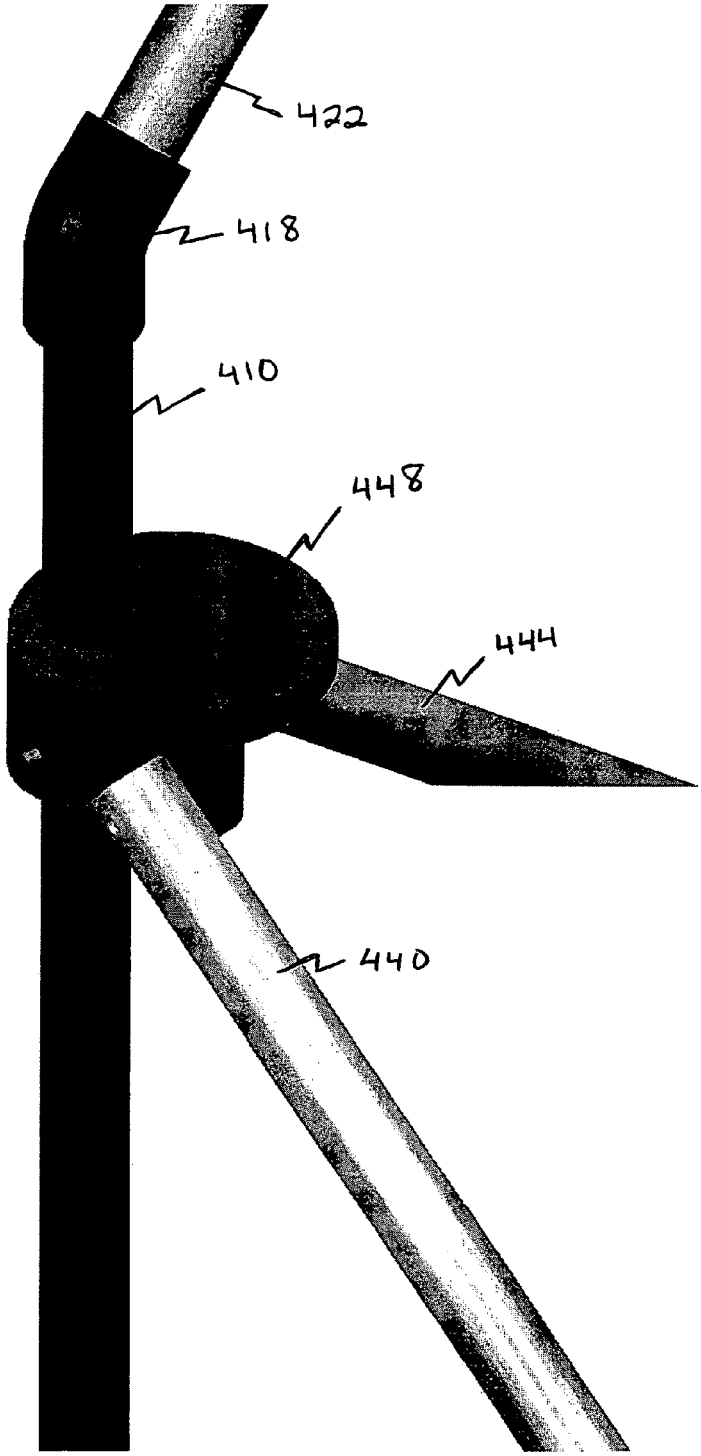
FIG. 9 is a perspective view of a cross member hinge suitable for use with a frame for a collapsible enclosure according to the embodiment illustrated in FIG. 4.

FIG. 9 is a perspective view of a cross member hinge suitable for use with a frame for a collapsible enclosure according to the embodiment illustrated in FIG. 4. This example shows left front cross member hinge 448 as discussed above. The cross member hinge 448 can be slidably coupled with upright member 410 via a cylindrical opening (not shown here) in the body of cross member hinge 448. The ends of cross members 440 and 444 are also shown. As noted, cross members 440 and 444 are adapted to pivot about cross member hinge 448. For example, a pin, rivet, screw, etc. (not shown here) may extend through the end of the cross members 440 and 444 and into the body of the cross member hinge 448 providing a pivot point for the cross members 440 and 444.

Also shown here is upright extension 422 coupled with upright member 410 via flexible joint 418. As noted above, flexible joint 418 allows upright extension 422 to pivot to become substantially collinear with upright support 410. Therefore, flexible joint may comprise a piece of tubing or other flexible material adapted to receive the ends of upright member 410 and upright extension 422. Alternatively, flexible joint 418 may comprise a hinge. Other variations are contemplated and considered to be within the scope of the present invention. Regardless of the exact configuration of flexible joint 418, the cylindrical cavity in the body of the cross member hinge 448 can be sized appropriately to allow the cross member hinge to slide over the flexible joint 418 when the frame is erected or collapsed.

Figure 10A:
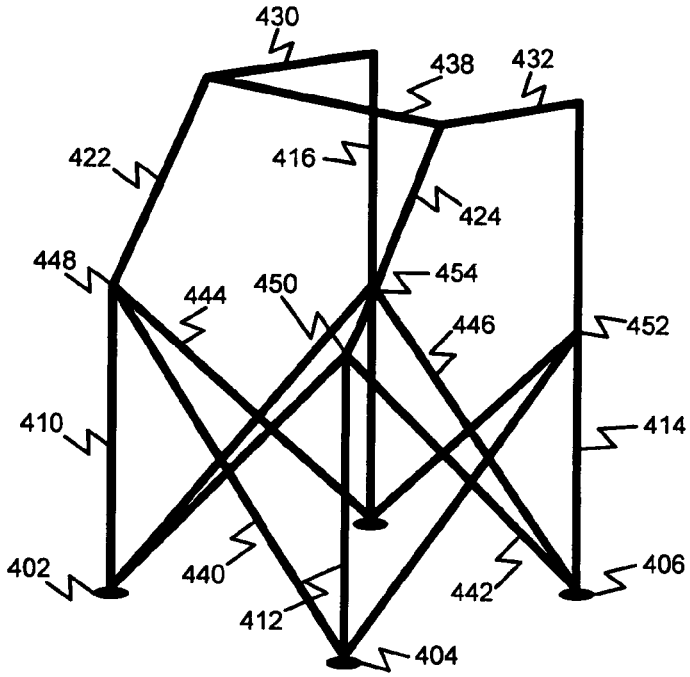
FIGS. 10A and 10B are perspective views of a collapsible enclosure in erected and partially collapsed state respectively according to one embodiment of the present invention.
Figure 10B:
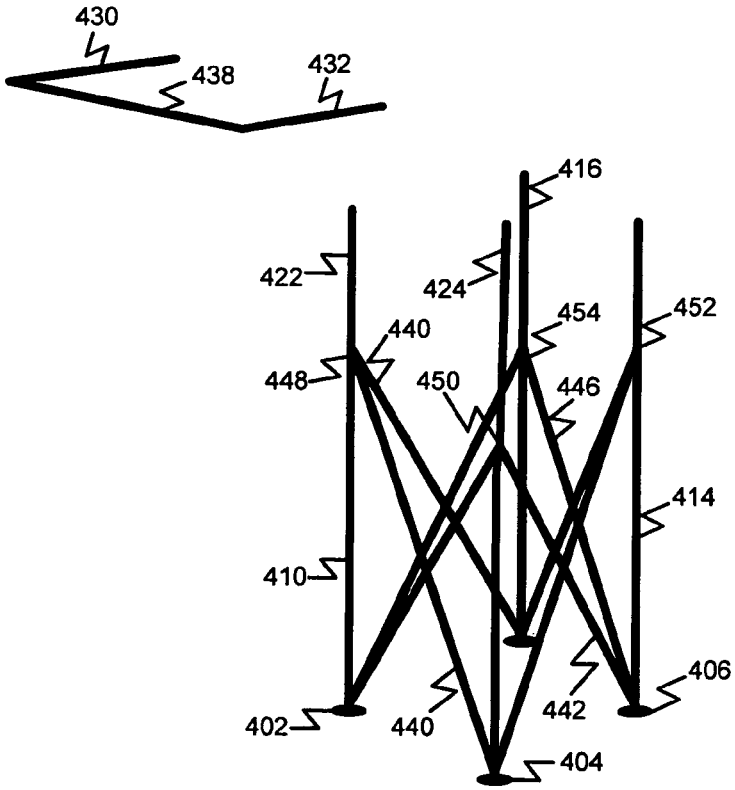

FIGS. 10A and 10B are perspective views of a collapsible enclosure in an erected and partially collapsed state according to one embodiment of the present invention. In the example of FIG. 10A, the frame is shown fully assembled and erect as it would be when in use. FIG. 10B shows the frame partially collapsed after the lateral support 438 and horizontal supports 430 and 432 have been removed. As explained above, the frame 205 can be collapsed by removing lateral support member 438 and disconnecting horizontal support members 430 and 432 from upright members 414 and 416. As noted, the horizontal supports 430 and 432, if any, may in some implementations be removed from the frame or may be hinged to the upright extensions 422 and 424 via the three-way joint. In any case, the supports are loosened so that the upright members 410-416 can be forced together.

Then, forcing the upright members 410-416 towards each other causes each cross member 440-444 to pivot about the base hinge 402-408 with which the cross member 440-444 is coupled and the cross member hinge 448-454 with which the cross member 440-444 is coupled and causes each cross member hinge 448-454 to slide along each upright member 410-416 in a direction away from the base hinges 402-408. As the cross member hinge passes over the flexible joints between the front uprights 410 and 412, the upright extensions 422 and 424 are forced upright to be substantially collinear with the front upright members 410 and 412 so that the cross member hinges 448-454 can continue to pass up the upright members 410-416 and upright extensions 422 and 424 as the upright members 410-416 are pushed together. The upright members 410-416 can be pressed together until touch each other to form a compact, convenient package for transportation and/or storage of the frame.

Assembly of the frame 205 can be accomplished by reversing these steps. That is, the upright members 410-416 can be drawn apart causing the each cross member 440-444 to pivot about the base hinge 402-408 with which the cross member 440-444 is coupled and the cross member hinge 448-454 with which the cross member 440-444 is coupled and causes each cross member hinge 448-454 to slide along each upright member 410-416 in a direction toward the base hinges 402-408. When the upright members 410-416 are drawn apart to their proper positions, the later support 438, if any, and/or the horizontal supports 430 and 432, if any, may be replaced to finish erection of the frame.

The various preferred embodiments and variations thereof illustrated in the accompanying Figures and/or described above are merely exemplary and are not meant to limit the scope of the invention. It is to be appreciated that numerous variations of the invention have been contemplated as would be obvious to one of ordinary skill in the art with the benefit of this disclosure. All variations of the cover that read upon the appended claims are intended and contemplated to be within the scope of the invention.

What is claimed is:

1. A collapsible enclosure for a machine tool comprising:

a substantially waterproof pan comprising a base portion and a wall portion extending from the base portion around substantially all of an outer edge of the base portion;

a collapsible frame resting on the base portion of the pan and erected inside of the wall portion of the pan, the frame comprising:

a plurality of upright members;

a plurality of base hinges, each base hinge mounted on a bottom end of each of the plurality of upright members;

a plurality of cross member hinges, each cross member hinge slidably coupled with each of the plurality of upright members;

a plurality of cross members coupled with and extending from each of the plurality of base hinges toward and coupled with an opposing cross member hinge of the plurality of cross member hinges, the cross members extending along an outside perimeter of the frame, each cross member of the plurality of cross members adapted to pivot about the base hinge with which the cross member is coupled in at least one direction in relation to the upright member on which the base hinge is mounted and to pivot about the cross member hinge with which the cross member is coupled in at least one direction in relation to the upright member with which the cross member hinge is coupled; and a substantially waterproof cover substantially surrounding the collapsible frame and extending into the pan to overlap an inner side of the wall portion of the pan.

2. The collapsible enclosure of claim 1, wherein forcing the upright members towards each other causes each cross member to pivot about the base hinge with which the cross member is coupled and the cross member hinge with which the cross member is coupled and causes each cross member hinge to slide along each upright member in a direction away from the base hinges.

3. The collapsible enclosure of claim 1, wherein the frame further comprises one or more support members removably coupled with opposing upright members at an end of the upright member opposite the base hinges and adapted to prevent the upright members from moving toward each other.

4. A collapsible enclosure for a machine tool comprising:

a substantially waterproof pan comprising a base portion and a wall portion extending from the base portion around substantially all of an outer edge of the base portion wherein the wall portion of the pan further comprises one or more fasteners on an inner side of the wall portion;

a collapsible frame resting on the base portion of the pan and erected inside of the wall portion of the pan, the frame comprising:

a plurality of upright members;

a plurality of base hinges, each base hinge mounted on a bottom end of each of the plurality of upright members;

a plurality of cross member hinges, each cross member hinge slidably coupled with each of the plurality of upright members;

a plurality of cross members coupled with and extending from each of the plurality of base hinges toward and coupled with an opposing cross member hinge of the plurality of cross member hinges, the cross members extending along an outside perimeter of the frame, each cross member of the plurality of cross members adapted to pivot about the base hinge with which the cross member is coupled in at least one direction in relation to the upright member on which the base hinge is mounted and to pivot about the cross member hinge with which the cross member is coupled in at least one direction in relation to the upright member with which the cross member hinge is coupled; and a substantially waterproof cover substantially surrounding the collapsible frame and extending into the pan to overlap the inner side of the wall portion of the pan wherein the cover further comprises one or more fasteners on an edge of the cover overlapping the inner side of the wall portion of the pan, the one or more fasteners on the cover adapted to couple with the one or more fasteners on the inner side of the wall portion and wherein the cover further defines an opening on at least one side of the collapsible enclosure, the opening adapted to provide access to a machine tool placed into the collapsible enclosure.

5. The collapsible enclosure of claim 4, wherein forcing the upright members towards each other causes each cross member to pivot about the base hinge with which the cross member is coupled and the cross member hinge with which the cross member is coupled and causes each cross member hinge to slide along each upright member in a direction away from the base hinges.

6. The collapsible enclosure of claim 4, wherein the frame further comprises one or more support members removably coupled with opposing upright members at an end of the upright member opposite the base hinges and adapted to prevent the upright members from moving toward each other.

7. A collapsible enclosure for a machine tool comprising:

a substantially waterproof pan comprising a base portion and a wall portion extending from the base portion around substantially all of an outer edge of the base portion;

a collapsible frame resting on the base portion of the pan and erected inside of the wall portion of the pan a plurality of upright members, the frame comprising a plurality of base hinges, each base hinge mounted on a bottom end of each of the plurality of upright members, a plurality of cross member hinges, each cross member hinge slidably coupled with each of the plurality of upright members, a plurality of cross members coupled with and extending from each of the plurality of base hinges toward and coupled with an opposing cross member hinge of the plurality of cross member hinges, the cross members extending along an outside perimeter of the frame, each cross member of the plurality of cross members adapted to pivot about the base hinge with which the cross member is coupled in at least one direction in relation to the upright member on which the base hinge is mounted and to pivot about the cross member hinge with which the cross member is coupled in at least one direction in relation to the upright member with which the cross member hinge is coupled; and a substantially waterproof cover substantially surrounding the collapsible frame and extending into the pan to overlap an inner side of the wall portion of the pan.

8. The collapsible enclosure of claim 7, wherein the wall portion of the pan further comprises one or more fasteners on an inner side of the wall portion.

9. The collapsible enclosure of claim 8, wherein the cover further comprises one or more fasteners on an edge of the cover overlapping the inner side of the wall portion of the pan, the one or more fasteners on the cover adapted to couple with the one or more fasteners on the inner side of the wall portion.

10. The collapsible enclosure of claim 8, wherein the frame further comprises one or more support members removably coupled with opposing upright members at an end of the upright member opposite the base hinges and adapted to prevent the upright members from moving toward each other.

11. The collapsible enclosure of claim 8, wherein the cover further comprises a substantially rectangular sheet and a plurality of fasteners near outer edges of the sheet, the fasteners adapted to secure opposing edges of the sheet when the sheet is placed over and folded around the frame of the collapsible enclosure.

12. The collapsible enclosure of claim 7, wherein the cover further defines an opening on at least one side of the collapsible enclosure, the opening adapted to provide access to a machine tool placed into the collapsible enclosure.

* * * * *